US010243286B2

(12) United States Patent
Brooks et al.

(10) Patent No.: US 10,243,286 B2
(45) Date of Patent: Mar. 26, 2019

(54) DISABLING DEVICE INCLUDING ADHESIVE TO DISABLE AN ELECTRICAL INTERFACE

(71) Applicant: Hewlett Packard Enterprise Development LP, Houston, TX (US)

(72) Inventors: Michael A. Brooks, Roseville, CA (US); Shadi F. Sakkab, Roseville, CA (US); Bryan D. Bolich, Davis, CA (US)

(73) Assignee: Hewlett Packard Enterprise Development LP, Houston, TX (US)

( * ) Notice: Subject to any disclaimer, the term of this patent is extended or adjusted under 35 U.S.C. 154(b) by 0 days.

(21) Appl. No.: 15/535,029

(22) PCT Filed: Dec. 17, 2014

(86) PCT No.: PCT/US2014/070830
§ 371 (c)(1),
(2) Date: Jun. 9, 2017

(87) PCT Pub. No.: WO2016/099484
PCT Pub. Date: Jun. 23, 2016

(65) Prior Publication Data
US 2017/0324174 A1 Nov. 9, 2017

(51) Int. Cl.

| | |
|---|---|
| ***H01R 12/70*** | (2011.01) |
| ***H01R 13/447*** | (2006.01) |
| ***H01R 13/46*** | (2006.01) |
| ***H01R 43/00*** | (2006.01) |

(52) U.S. Cl.
CPC ..... *H01R 12/7076* (2013.01); *H01R 13/447* (2013.01); *H01R 13/465* (2013.01); *H01R 43/00* (2013.01)

(58) Field of Classification Search
CPC .. H01R 12/7076; H01R 43/00; H01R 13/447; H01R 13/465; H01R 43/20; H01R 43/205; H05K 3/305; H05K 3/321; Y10T 29/4913; Y10T 29/49169
See application file for complete search history.

(56) References Cited

U.S. PATENT DOCUMENTS 3,201,740 A * 8/1965 Rubens ..... H01R 13/447 174/67
4,246,307 A * 1/1981 Trautwein ..... B32B 7/14 428/43
4,305,767 A * 12/1981 Corey ..... G09F 3/02 156/249
4,618,740 A * 10/1986 Ray ..... H01R 13/44 174/67
5,051,870 A * 9/1991 Companion ..... H01L 23/544 156/63
5,342,995 A * 8/1994 Comerci ..... H01R 13/447 174/67

(Continued)

FOREIGN PATENT DOCUMENTS

EP 0910233 9/2002

*Primary Examiner* — Edwin A. Leon
*Assistant Examiner* — Oscar Jimenez
(74) *Attorney, Agent, or Firm* — Hewlett Packard Enterprise Patent Department

(57) ABSTRACT

A disabling device includes an adhesive layer and/or a self-hardening material. The adhesive layer or self-hardening material contacts electrical contacts of an electrical interface.

14 Claims, 5 Drawing Sheets

(56) References Cited

U.S. PATENT DOCUMENTS

| | | | | |
|---|---|---|---|---|
| 5,785,541 | A * | 7/1998 | Best | B60R 16/027 439/15 |
| 5,940,959 | A * | 8/1999 | Caveney | H01R 13/6625 29/25.42 |
| 5,949,059 | A * | 9/1999 | Rawson, Sr. | G06K 19/073 235/487 |
| 6,161,915 | A * | 12/2000 | Bolash | B41J 2/17546 347/19 |
| 6,281,695 | B1 * | 8/2001 | Chung | G01R 1/0408 257/48 |
| 6,995,462 | B2 | 2/2006 | Bolken | |
| 7,365,421 | B2 | 4/2008 | Webster | |
| 7,534,653 | B2 | 5/2009 | Hsuan | |
| 7,978,070 | B2 | 7/2011 | Hunter | |
| 8,664,758 | B2 | 3/2014 | Lai | |
| 2007/0290374 | A1 | 12/2007 | Wolfgang | |
| 2008/0237317 | A1 * | 10/2008 | Rosendall | B65D 73/0042 229/102 |
| 2011/0134620 | A1 * | 6/2011 | Kang | G06K 19/07732 361/783 |
| 2013/0251944 | A1 * | 9/2013 | Kian | C09J 7/0217 428/141 |
| 2014/0049887 | A1 * | 2/2014 | Salle | G06F 21/86 361/679.01 |
| 2014/0099024 | A1 * | 4/2014 | Remer | G06K 9/78 382/165 |
| 2014/0184415 | A1 | 7/2014 | Edmonds | |

* cited by examiner

DISABLING DEVICE INCLUDING ADHESIVE TO DISABLE AN ELECTRICAL INTERFACE

BACKGROUND

Electrical devices such as servers, and the like, may include printed circuit assemblies. The printed circuit assemblies include multiple, electrical interfaces to receive removable, configurable components.

BRIEF DESCRIPTION OF THE DRAWINGS

The present embodiments will now be described, by way of example, with reference to the accompanying drawings, in which.

DETAILED DESCRIPTION

Electrical devices such as servers, and the like, may include printed circuit assemblies. The printed circuit assemblies include multiple, electrical interfaces to receive removable, configurable components, The removable, configurable component is an electrical component that is added to the printed circuit assembly after the primary manufacturing process of the printed circuit assembly. Removable, configurable components may include processor chips, socketed programmable components, switch components, and/or application-specific integrated circuits (ASIC), and the like.

However, at times, the use of a particular removable, configurable component may not be desired and/or authorized for certain printed circuit assemblies and/or customers. Typically, disablement of respective removable, configurable components include building a circuit on the printed circuit assembly or firmware/software to disable/enable the removable, configurable component from being used therein. However, such disablement may increase components, board area, and design time of the printed circuit assemblies. Further, a firmware/software solution may be circumvented and/or not meet desired criteria such as licensing terms.

In examples, the disabling device is usable with an electrical interface having electrical contacts of a printed circuit assembly to receive a removable, configurable component, The disabling device includes an adhesive layer, a backing layer, and an upper layer. The adhesive layer includes a non electrically-conductive adhesive to contact the electrical contacts of the electrical interface. The backing layer removably couples to the adhesive layer. The upper layer couples to the adhesive layer. The upper layer includes a tamper-proof member to enable at least a portion of the non electrically-conductive adhesive to remain on the electrical contacts and/or cause damage to the electrical contacts in response to removal of the upper layer therefrom. Thus, the disabling device enables the permanent disablement of electrical interfaces without redesigning the printed circuit assembly or manufacturing method thereof in a cost-effective manner. Thus, additional board space, development time, and versions of the printed circuit assembly is not necessitated.

Figure 1:
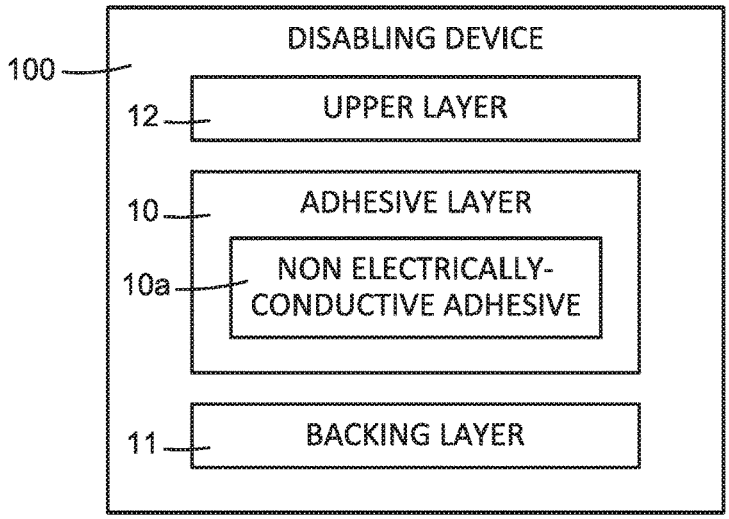
FIG. 1 is a block diagram illustrating a disabling device according to an example.

FIG. 1 is a block diagram illustrating a disabling device according to an example. Referring to FIG. 1, in some examples, the disabling device 100 is usable with an electrical interface having electrical contacts of a printed circuit assembly to receive a removable, configurable component. The electrical interface, for example, may include a housing surrounding electrical contacts to receive a removable, configurable component. The removable, configurable component is an electrical component that is added to the printed circuit assembly after the primary manufacturing process of the printed circuit assembly.

The addition of a removable, configurable may provide additional functionality to the printed circuit assembly. Removable, configurable components may include processor chips, socketed programmable components, switch components, and/or application-specific integrated circuits (ASIC), and the like. The disabling device 100 includes an adhesive layer 10, a backing layer 11, and an upper layer 12. The adhesive layer 10 includes a non electrically-conductive adhesive to contact the electrical contacts of the electrical interface. The backing layer 11 removably couples to the adhesive layer 10, That is, the backing layer 11 is a removable, adhesive liner. The upper layer 12 couples to the adhesive layer 10.

Figure 2:
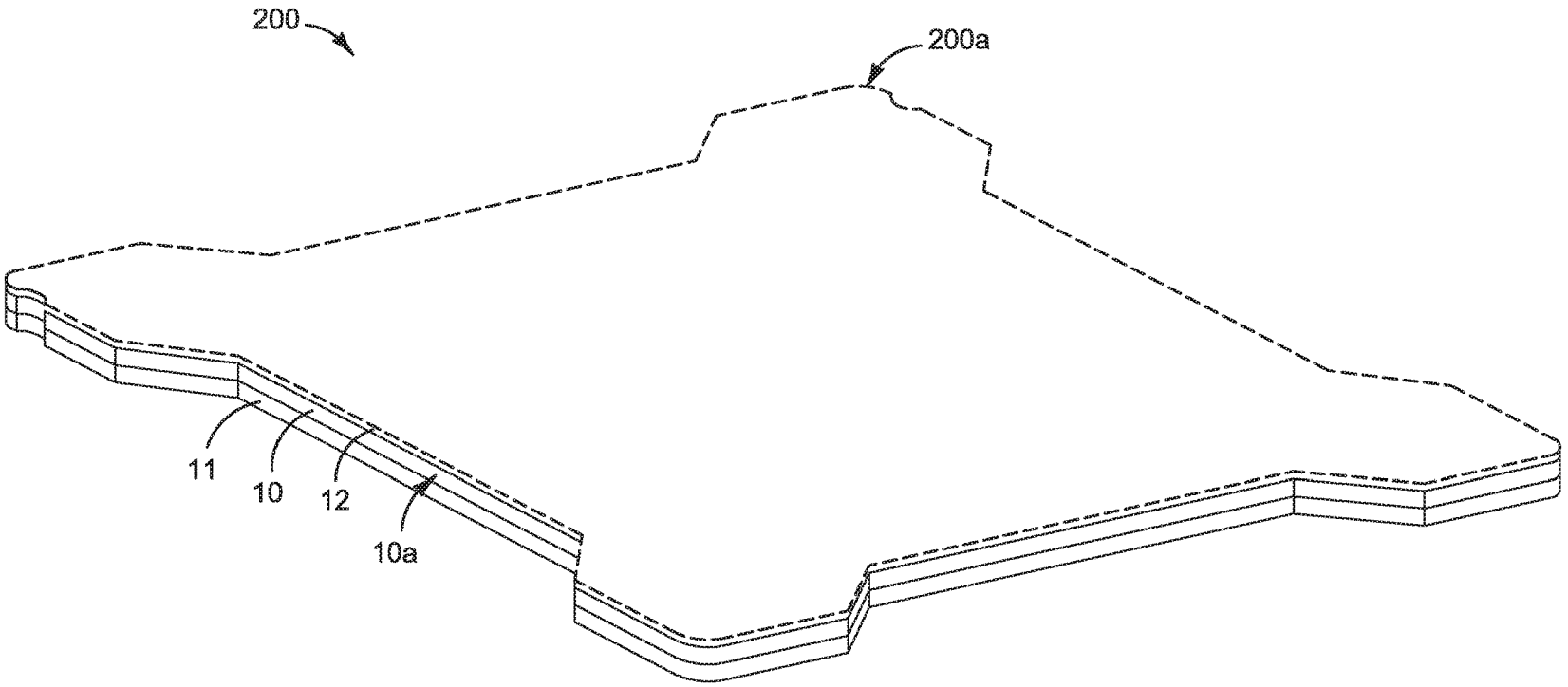
FIG. 2 is a perspective view illustrating a disabling device according to an example.
Figure 3:
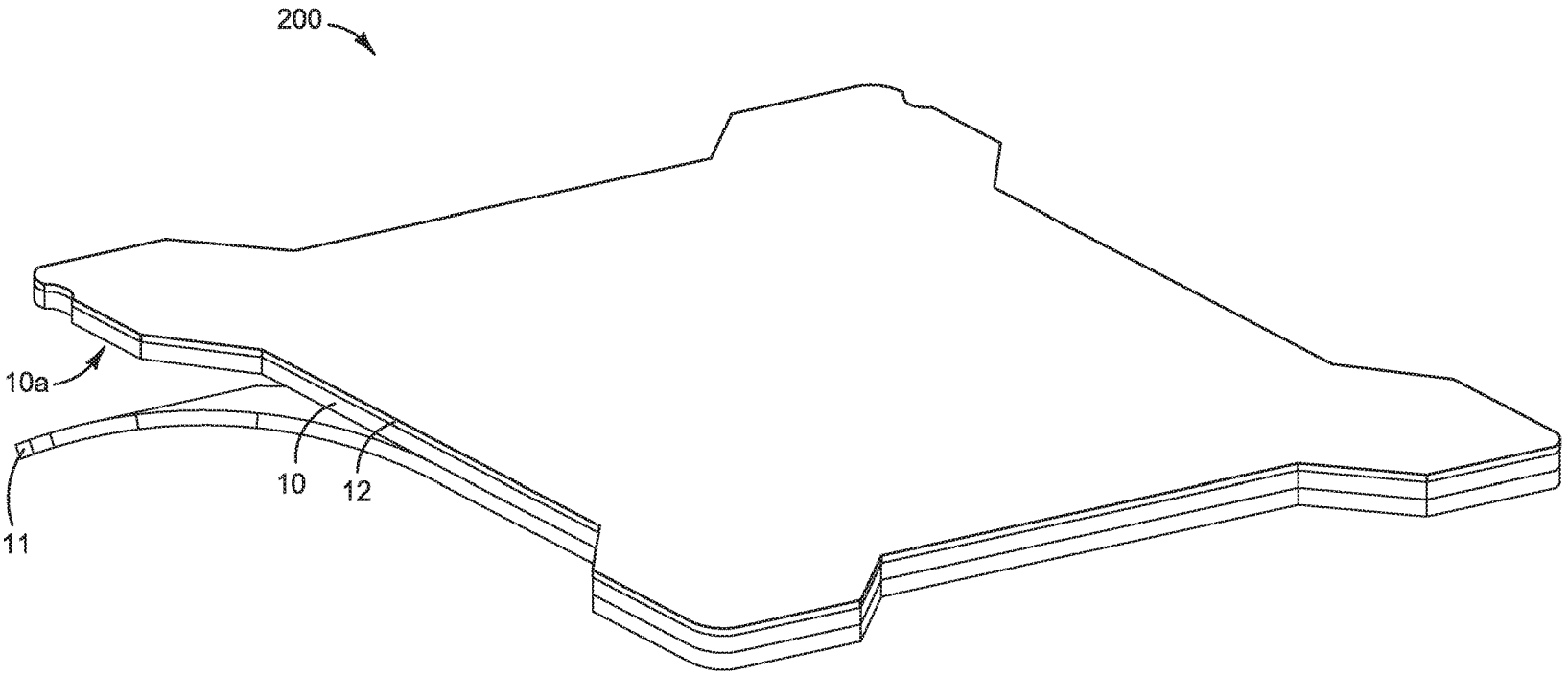
FIG. 3 is a schematic view illustrating the disabling device of FIG. 2 with a backing layer partially removed therefrom according to an example.

FIG. 2 is a perspective view illustrating a disabling device according to an example. FIG. 3 is a schematic view illustrating the disabling device of FIG. 2 with a backing layer partially removed therefrom according to an example. The disabling device 200 includes the adhesive layer 10, the backing layer 11, and the upper layer 12 previously described with respect to the disabling device 100 of FIG. 1. In some examples, the disabling device 200 includes a disabling device circumference 200*a* that corresponds to a component circumference of the electrical interface. For example, the disabling device 200 may conform to and occupy the space intended for the removable, configurable component. Additionally, in some examples, the disabling device 200 having a shape corresponding to the component circumference may provide other desired functionality such as a heat sink function, an airflow baffle function, a structural component function, and the like. The backing layer 11 removably couples to the adhesive layer 10. In some examples, the backing layer 11 includes plastic, vinyl, glossy paper, and the like.

Referring to FIGS, 2 and 3, in some examples, the adhesive layer 10 includes a non electrically-conductive adhesive 10*a* to contact the electrical contacts of the electrical interface. For example, the non electrically-conductive adhesive 10*a* strongly sticks to the electrical contacts. In some examples, the non electrically-conductive adhesive 10*a* includes an adhesive strength of at least twenty-five pounds per square inch (psi). In some examples, the non electrically-conductive adhesive 10*a* includes an acrylic adhesive, a rubber-based adhesive, and the like.

Referring to FIGS. 2 and 3, in some examples, the upper layer 12 couples to the adhesive layer 10. In some examples, the upper layer 12 includes a tamper-proof member to enable at least a portion of the non electrically-conductive adhesive

10*a* to remain on the electrical contacts in a response to removal of the tamper-proof member from the electrical interface. For example, the tamper-proof member may include the upper layer 12 having sufficient adhesion with the adhesive layer 10 such that the upper layer 12 separates from the adhesive layer 10, when removed by a user, leaving behind at least a portion of the non electrically-conductive adhesive 10*a* on the electrical contacts.

Alternatively, the tamper-proof member may enable the non electrically-conductive adhesive to at least one of break and bend the electrical contacts. For example, the tamper-proof member may include the upper layer 12 having sufficient adhesion with the adhesive layer 10 such that the upper layer 12 adheres to the adhesive layer 10 which adheres to the electrical contacts, when pulled on from a user, enabling the electrical contacts to also be pulled and damaged. In some examples, the upper layer 12 includes a polycarbonate material, and the like. In some examples, the upper layer 12 has a thickness in a range of 0.25 millimeters (mm) to 1.0 mm.

Figure 4:
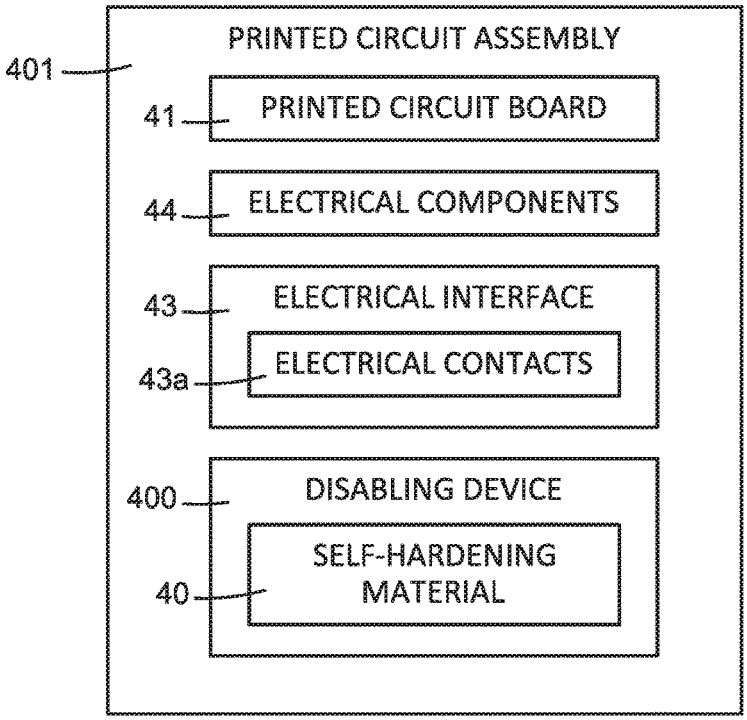
FIG. 4 is a block diagram illustrating a printed circuit assembly according to an example.
Figure 5:
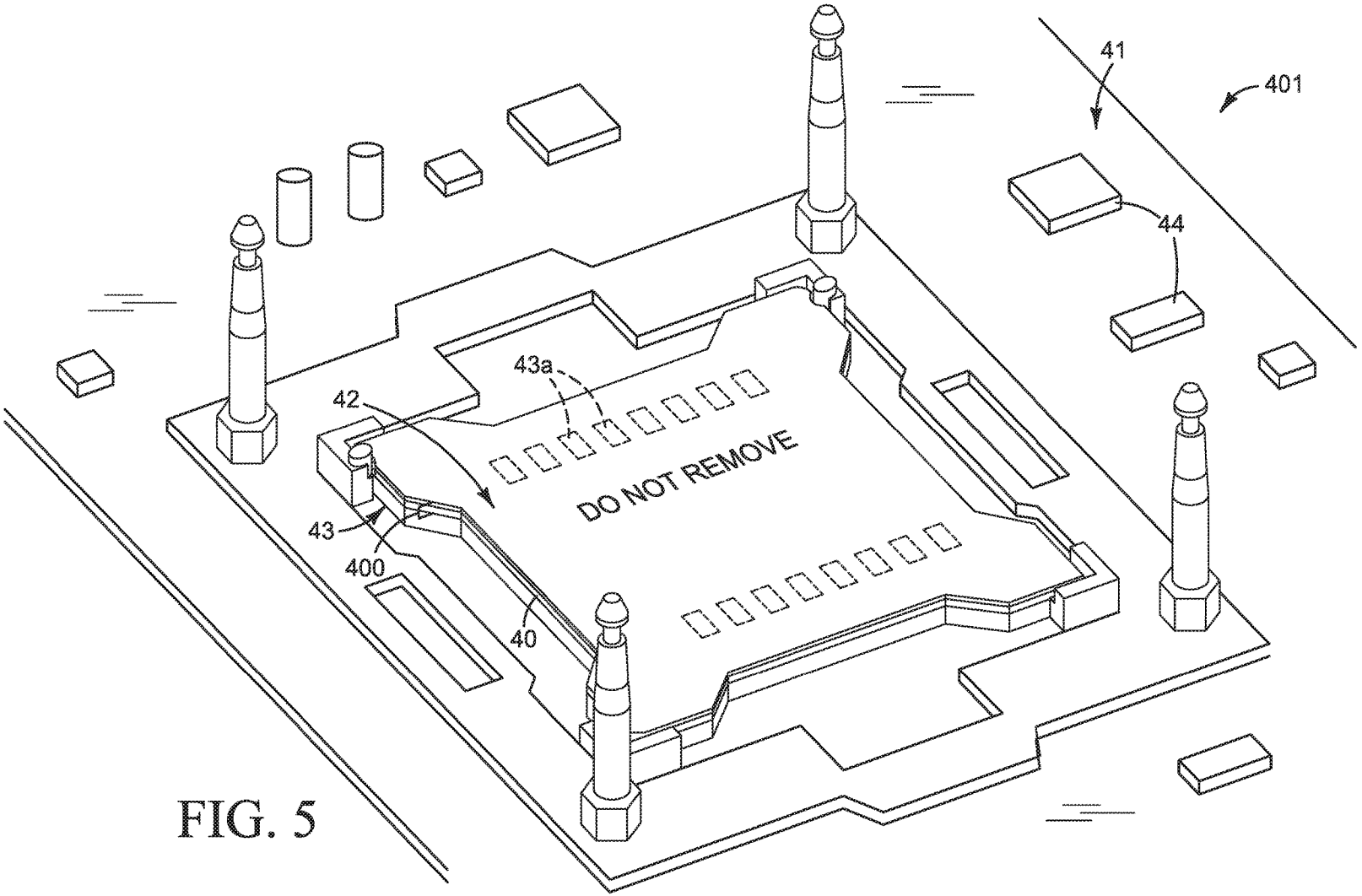
FIG. 5 is a schematic view illustrating the printed circuit assembly of FIG. 4 according to an example.

FIG. 4 is a block diagram illustrating a printed circuit assembly according to an example. FIG. 5 is a schematic view illustrating the printed circuit assembly of FIG. 4 according to an example. Referring to FIGS. 4 and 5, in some examples, the printed circuit assembly 401 includes a printed circuit board 41, a plurality of electrical components 44, an electrical interface 43, a disabling device 400, and a label 42. The electrical interface 43 includes electrical contacts 43*a* to receive a removable, configurable component. In some examples, the electrical contacts 43*a* include at least one of electrical pins and electrical pads.

Referring to FIGS. 4 and 5, in some examples, the removable, configurable components may include processor chips, socketed programmable components, switch components, and/or application-specific integrated circuits (ASIC), and the like. The disabling device 400 includes a self-hardening material 40 to contact the electrical contacts 43*a* to disable the electrical interface 43 from receiving the removable, configurable component. In some examples, the self-hardening material 40 includes a non electrically-conductive adhesive. In some examples, the self-hardening material 40 includes an epoxy, and/or cyanoacrylate adhesive, and the like. The label 42 conveys information to a user. The label 42 may include images, symbols, alphanumeric characters, and the like.

Figure 6:
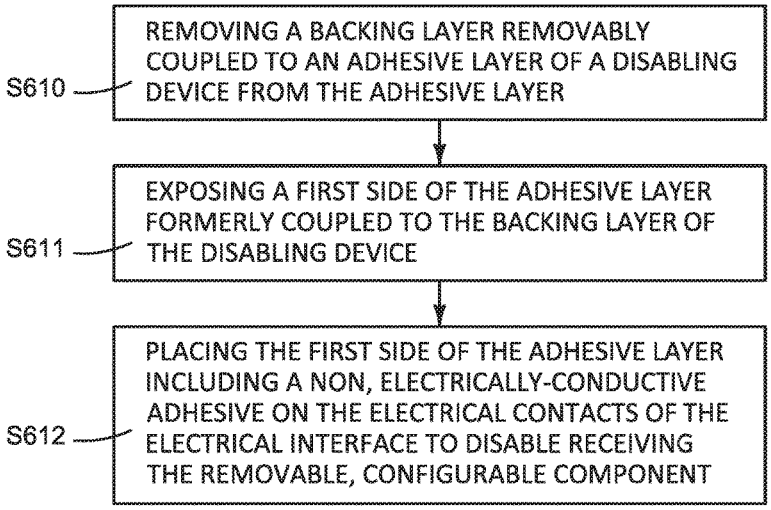
FIG. 6 is a flowchart of a method of disabling an electrical interface including electrical contacts of a printed circuit assembly to receive a removable, configurable component according to an example.

FIG. 6 is a flowchart of a method of disabling an electrical interface including electrical contacts of a printed circuit assembly to receive a removable, configurable component according to an example. The method is associated with examples of the disabling devices 100, 200, and 400 illustrated in FIGS. 1-5 and the related description above. In block S610, a backing layer removably coupled to an adhesive layer of a disabling device is removed from the adhesive layer. In block S611, a first side of the adhesive layer formerly coupled to the backing layer of the disabling device is exposed.

In block S612, the first side of the adhesive layer including a non electrically-conductive adhesive is placed on the electrical contacts of the electrical interface to disable receiving the removable, configurable component. For example, at least a portion of the non electrically-conductive adhesive is enabled to remain on the electrical contacts of the electrical interface. That is, in response to a removal of an upper layer coupled to the adhesive layer of the disabling device from the electrical interface. The electrical interface is disabled from receiving the removable, configurable component. Further, in some examples, an upper layer coupled to the adhesive layer of the disabling device is placed to have a label attached to the upper layer face away from the electrical interface.

It is to be understood that the flowchart of FIG. 6 illustrates architecture, functionality, and/or operation of examples of the present disclosure. Each block may represent one or several blocks to implement the specified function(s). Although the flowchart of FIG. 6 illustrates a specific order of execution, the order of execution may differ from that which is depicted. For example, the order of execution of two or more blocks may be rearranged relative to the order illustrated. Also, two or more blocks illustrated in succession in FIG. 6 may be executed concurrently or with partial concurrence. All such variations are within the scope of the present disclosure.

The present disclosure has been described using non-limiting detailed descriptions of examples thereof that are not intended to limit the scope of the general inventive concept. It should be understood that features and/or operations described with respect to one example may be used with other examples and that not all examples have all of the features and/or operations illustrated in a particular figure or described with respect to one of the examples. Variations of examples described will occur to persons of the art. Furthermore, the terms "comprise," "include," "have" and their conjugates, shall mean, when used in the disclosure and/or claims, "including but not necessarily limited to."

It is noted that some of the above described examples may include structure, acts or details of structures and acts that may not be essential to the general inventive concept and which are described for illustrative purposes. Structure and acts described herein are replaceable by equivalents, which perform the same function, even if the structure or acts are different, as known in the art. Therefore, the scope of the general inventive concept is limited only by the elements and limitations as used in the claims.

What is claimed is:

1. A disabling device usable with an electrical interface of a printed circuit assembly, the electrical interface having electrical contacts to receive a removable and configurable component, the disabling device comprising:

an adhesive layer including a non electrically-conductive adhesive;

a backing layer removably coupled to the adhesive layer; and an upper layer coupled to the adhesive layer, wherein the non electrically-conductive adhesive is configured to contact the electrical contacts in response to the backing layer being removed and the disabling device being installed on the electrical interface, and wherein the upper layer comprises a tamper-proof member that is configured to enable the non electrically-conductive adhesive to break the electrical contacts of the printed circuit assembly in response to the upper layer being removed from the electrical interface.

2. The disabling device of claim 1, wherein the non electrically-conductive adhesive includes an adhesive strength of at least twenty-five pounds per square inch (psi).

3. The disabling device of claim 1, wherein the upper layer comprises:

a label to convey information to a user.

4. The disabling device of claim 1, wherein the tamper-proof member is to enable at least a portion of the non electrically-conductive adhesive to remain on the electrical contacts in response to removal of the tamper-proof member from the electrical interface.

5. The disabling device of claim 1, further comprising:

a disabling device circumference that corresponds to a component circumference of the electrical interface.

6. The disabling device of claim 1, wherein the non electrically-conductive adhesive comprises at least one of an acrylic adhesive and a rubber-based adhesive.

7. The disabling device of claim 1, wherein the backing layer comprises at least one of plastic, vinyl, and a glossy paper and the upper layer includes a polycarbonate material.

8. A method of disabling an electrical interface including electrical contacts of a printed circuit assembly to receive a removable and configurable component, the method comprising:

removing a backing layer from an adhesive layer of a disabling device and thereby exposing a first side of the adhesive layer that was formerly coupled to the backing layer, the adhesive layer including a non electrically-conductive adhesive; and disabling the electrical interface from receiving the removable and configurable component by placing the first side of the adhesive layer in contact with the electrical contacts, wherein the disabling device includes an upper layer that is attached to the adhesive layer and that comprises a tamper-proof member that is configured to enable the non electrically-conductive adhesive to bend the electrical contacts of the printed circuit assembly in response to the upper layer being removed from the electrical interface.

9. The method of claim 8, wherein the adhesive is configured to leave a portion of the non electrically-conductive adhesive on the electrical contacts of the electrical interface in response to a removal of the upper layer from the electrical interface.

10. The method of claim 8, wherein the upper layer comprises a label facing away from the electrical interface.

11. A printed circuit assembly, comprising: a printed circuit board; a plurality of electrical components coupled to the printed circuit board; and an electrical interface including electrical contacts to receive a removable and configurable component; and a disabling device including a self-hardening material that is in contact with the electrical contacts, the disabling device disabling the electrical interface from receiving the removable and configurable component; wherein the disabling device includes an upper layer that is attached to the self-hardening material and that comprises a tamperproof member that is configured to enable the self-hardening material to permanently damage the electrical contacts of the printed circuit assemble in response to the upper layer being removed from the electrical interface.

12. The printed circuit assembly of claim 11, further comprising:

a label on the self-hardening material to convey information to a user.

13. The printed circuit assembly of claim 11, wherein the self-hardening material comprises at least one of an epoxy or a cyanoacrylate adhesive.

14. The printed circuit assembly of claim 11, wherein the electrical contacts comprise:

at least one of electrical pins and electrical pads.

* * * * *